US006872098B2

(12) United States Patent
Wojtacki et al.

(10) Patent No.: US 6,872,098 B2
(45) Date of Patent: Mar. 29, 2005

(54) MODULAR JACK ASSEMBLY WITH SIGNAL CONDITIONING

(75) Inventors: Thomas Wojtacki, Greensboro, NC (US); Kevin J. Peterson, High Point, NC (US); Kurt T. Zarbock, Advance, NC (US); Joseph E. Geniac, Greensboro, NC (US); William J. Remaley, Walkertown, NC (US); Michael G. Pacyga, Clemmons, NC (US); Aurelio J. Gutierrez, Bonita, CA (US)

(73) Assignee: Tyco Electronics Corporation, Middletown, PA (US)

( * ) Notice: Subject to any disclaimer, the term of this patent is extended or adjusted under 35 U.S.C. 154(b) by 178 days.

(21) Appl. No.: 10/209,377

(22) Filed: Jul. 31, 2002

(65) Prior Publication Data

US 2003/0077941 A1 Apr. 24, 2003

(Under 37 CFR 1.47)

Related U.S. Application Data

(60) Provisional application No. 60/331,366, filed on Oct. 19, 2001, and provisional application No. 60/347,747, filed on Jan. 11, 2002.

(51) Int. Cl.[7] ..... H01R 24/00

(52) U.S. Cl. ..... 439/676; 639/620

(58) Field of Search ..... 439/676, 620, 439/541.5, 542, 607

(56) References Cited

U.S. PATENT DOCUMENTS

| | | | | |
|---|---|---|---|---|
| 5,531,612 | A | 7/1996 | Goodall et al. | 439/541.4 |
| 6,022,245 | A | 2/2000 | Minich | 439/620 |
| 6,132,260 | A | 10/2000 | Wu | 439/676 |
| 6,193,560 | B1 | 2/2001 | Morana et al. | 439/676 |
| 6,227,911 | B1 | 5/2001 | Boutros et al. | 439/620 |
| 6,579,121 | B2 * | 6/2003 | Belopolsky | 439/541.5 |
| 6,685,504 | B1 * | 2/2004 | Espenshade | 439/541.5 |

* cited by examiner

*Primary Examiner*—Briggitte R. Hammond

(57) ABSTRACT

The invention discloses a modular jack assembly comprised of an outer housing and a plurality of modular jack subassemblies. The modular jack subassemblies are comprised of an elongate beam support having a plurality of modular jack contacts on both sides thereof. The contacts extend into printed circuit board contacts and extend to and beyond the side edges of the elongate beam platform, leaving the space above and below the printed circuit board contacts and the beam support free, to accommodate signal conditioning componentry. Two printed circuit board modules are mounted orthogonally to the side edges of the beam support and include signal conditioning components. The assemblies are insertable into the housing defining modular jacks in the outer housing.

45 Claims, 15 Drawing Sheets

MODULAR JACK ASSEMBLY WITH SIGNAL CONDITIONING

This application claims the benefit of U.S. Provisional Patent Application Ser. Nos. 60/331,366 filed Oct. 19, 2001, and 60/347,747 filed Jan. 11, 2002, the complete disclosure of which is hereby expressly incorporated by reference.

BACKGROUND OF THE INVENTION

The invention relates to a connection assembly providing multiple port connections.

Known connector assemblies exist having multiple receptacle connectors in a common housing, which provides a compact arrangement of such receptacle connectors. Such a connector assembly is useful to provide multiple connection ports. Accordingly, such a connector assembly is referred to as a multiple port connector assembly. In preferred arrays, the housing has jacks one above the other, forming a plurality of arrays in stacked arrangement, so-called stacked jack arrangements. The receptacle connectors, that is, modular jacks, each have electrical terminals arranged in a terminal array, and have plug receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug-receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

One application for such connector assemblies is in the field of telephony wherein the modular jacks provide ports for connection with a telephone switching network of a telephone service provider, such as, a regional telephone company or national telephone company. The corresponding RJ-11 modular plugs terminate opposite ends of telephone cords leading to wall mounted telephone outlets inside a building. The telephone outlets connect to telephone lines outside of the building, which, in turn, connect to the telephone switching network of the telephone service provider.

Alternatively, such connection systems have found utility in office computer networks, where desktops are interconnected to office servers by way of sophisticated cabling. Such networks have a variety of data transmission medium including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore the volume within the assembly is inadequate to provide the proper signal conditioning devices for the high speeds now required.

The objects of the inventions are therefore to overcome the shortcomings of the prior art.

BRIEF SUMMARY OF THE INVENTION

The objects of the invention have been accomplished by providing an electrical connector assembly, comprising a modular jack housing having an elongate beam platform having a front end, rear end, upper and lower surfaces, and side edges. A plurality of electrical contacts are positioned on the modular jack housing, including an upper row adjacent to the upper surface and a lower row adjacent to the lower surface, each of the upper and lower rows of contacts having mating contact portions extending adjacent to the front end, and the upper row having printed circuit board connecting contacts extending beyond one of the side edges, and the lower row of contacts having printed circuit board connecting contacts extending beyond the opposite side edge. Signal conditioning devices comprised of printed circuit cards having signal conditioning components thereon, are mounted to the side edges and are electrically connected to the printed circuit card connecting contacts.

In the preferred embodiment of the invention, an outer housing has a front face having at least one pair of plug receiving openings, one above the other, and the modular jack assembly is positionable within the housing with the upper row of contacts adjacent to an upper one of the at least two plug receiving openings, and with the lower row of contacts adjacent to a lower one of the at least two plug receiving openings. The elongate beam platform includes a plurality of channels within the upper and lower surface to receive the contacts. The electrical contacts are formed as modular jack contacts with base portions extending in the channels, and reversely bent portions extending away from the upper and lower surfaces.

The outer housing includes upper and lower front compartments for receipt of the reversely bent contact portions, and upper and lower rear compartments, above and below the elongate beam platform. The printed circuit cards have signal conditioning components mounted thereon, and the components are positioned on the printed circuit cards and are located within the upper and lower rear components. The printed circuit cards further comprise printed circuit board pins connected thereto, where the printed circuit board pins are interconnected to the printed circuit card connecting contacts through the printed circuit card and through the signal conditioning components. The signal conditioning components and the printed circuit board pins are positioned within the inside facing surfaces of the printed circuit cards.

Also preferably, a plurality of pairs of plug receiving openings, define a row of a plurality of upper plug receiving openings, and a row of a plurality of lower plug receiving openings; and the assembly further comprises a plurality of modular jack housings laterally aligned with the upper and lower plug receiving openings. The assembly may also include a shield member positioned between at least some of the modular jack housings.

In another aspect of the invention, an electrical connector assembly comprises a housing member having an upper row of plug receiving openings and a lower row of plug receiving openings, where the upper and lower rows of plug receiving openings are laterally aligned. A modular jack housing comprises an elongate beam platform having a front end, rear end, upper and lower surfaces, and side edges. A plurality of electrical contacts are positioned on the modular jack housing, including an upper row adjacent to the upper surface and a lower row adjacent to the lower surface. Each of the upper and lower rows of contacts have mating contact portions extending adjacent to the front end. The upper row have printed circuit board connecting contacts extending beyond one of the side edges, and the lower row of contacts have printed circuit board connecting contacts extending beyond the opposite side edge.

The modular jack housing and contacts are receivable within the housing member to align the mating contact portions with associated plug receiving openings.

In the preferred embodiment, the assembly further comprises printed circuit cards mounted to the side edges of the elongate beam platform. The printed circuit cards include printed circuit board pins extending downwardly therefrom, for connection to a printed circuit board. The electrical contacts are electrically interconnected to the printed circuit board pins, through the printed circuit cards. The signal conditioning devices are positioned on the printed circuit cards, intermediate the printed circuit board connecting contacts and the printed circuit board pins. The signal conditioning devices are positioned on inside facing surfaces of the printed circuit cards. The printed circuit board pins are positioned within the inside facing surfaces of the printed circuit cards. The assembly further comprises an outer shield member substantially surrounding the housing member and shield members positioned between at least some of the jack housings.

In yet another embodiment of the invention, an electrical connector assembly comprises a housing member having an upper plug receiving opening and a lower plug receiving opening, the upper and lower plug receiving openings being laterally aligned. A modular jack housing assembly comprises an elongate platform having a front end, rear end, and upper and lower surfaces. The modular jack assembly further comprises a plurality of upper and lower electrical conductors, where the upper electrical conductors comprise mating contacts extending upwardly from the upper surface of the platform, upper intermediate conductors adjacent the upper surface and extending towards the rear end, and conductor connecting sections at ends thereof. The lower electrical conductors comprise mating contacts extending downwardly from the lower surface, lower intermediate conductors adjacent the lower surface and extending towards the rear end, and conductor connecting sections at ends thereof. Substrates are mounted to the elongate platform, having printed circuit board connecting contacts extending therefrom for further connection to a printed circuit board, the substrates being mounted orthogonally relative to the elongate platform, and carrying signal conditioning devices thereon. The printed circuit board connecting contacts are commoned to select ones of the upper and lower mating contacts, through the substrates and through the signal conditioning devices.

In this preferred version, the elongate platform includes a plurality of channels within the upper and lower surface to receive the upper and lower electrical conductors. The upper and lower electrical conductors are formed as modular jack contacts with base portions extending in the channels, and reversely bent portions extending away from the upper and lower surfaces. The upper electrical conductors have printed circuit board connecting contacts extending beyond one side edge of the elongate platform, and the lower electrical conductors have printed circuit board connecting contacts extending beyond an opposite side edge of the elongate platform. The substrates are comprised of printed circuit cards mounted to the side edges and electrically connected to the printed circuit card connecting contacts. The signal conditioning components are positioned on inside facing surfaces of the printed circuit cards, and the printed circuit board connecting contacts are positioned within the inside facing surfaces of the printed circuit cards. The assembly includes a plurality of pairs of plug receiving openings, defining a row of a plurality of upper plug receiving openings, and a row of a plurality of lower plug receiving openings. The assembly further includes a plurality of modular jack housings laterally aligned with the upper and lower plug receiving openings. The assembly may also include a shield member positioned between at least some of the modular jack housings and an outer shield member substantially surrounding the housing member.

BRIEF DESCRIPTION OF THE DRAWINGS

FIG. 2A is an enlarged perspective view of the connector subassembly of FIG. 2 assembled;

DETAILED DESCRIPTION OF THE EMBODIMENTS

Figure 1:
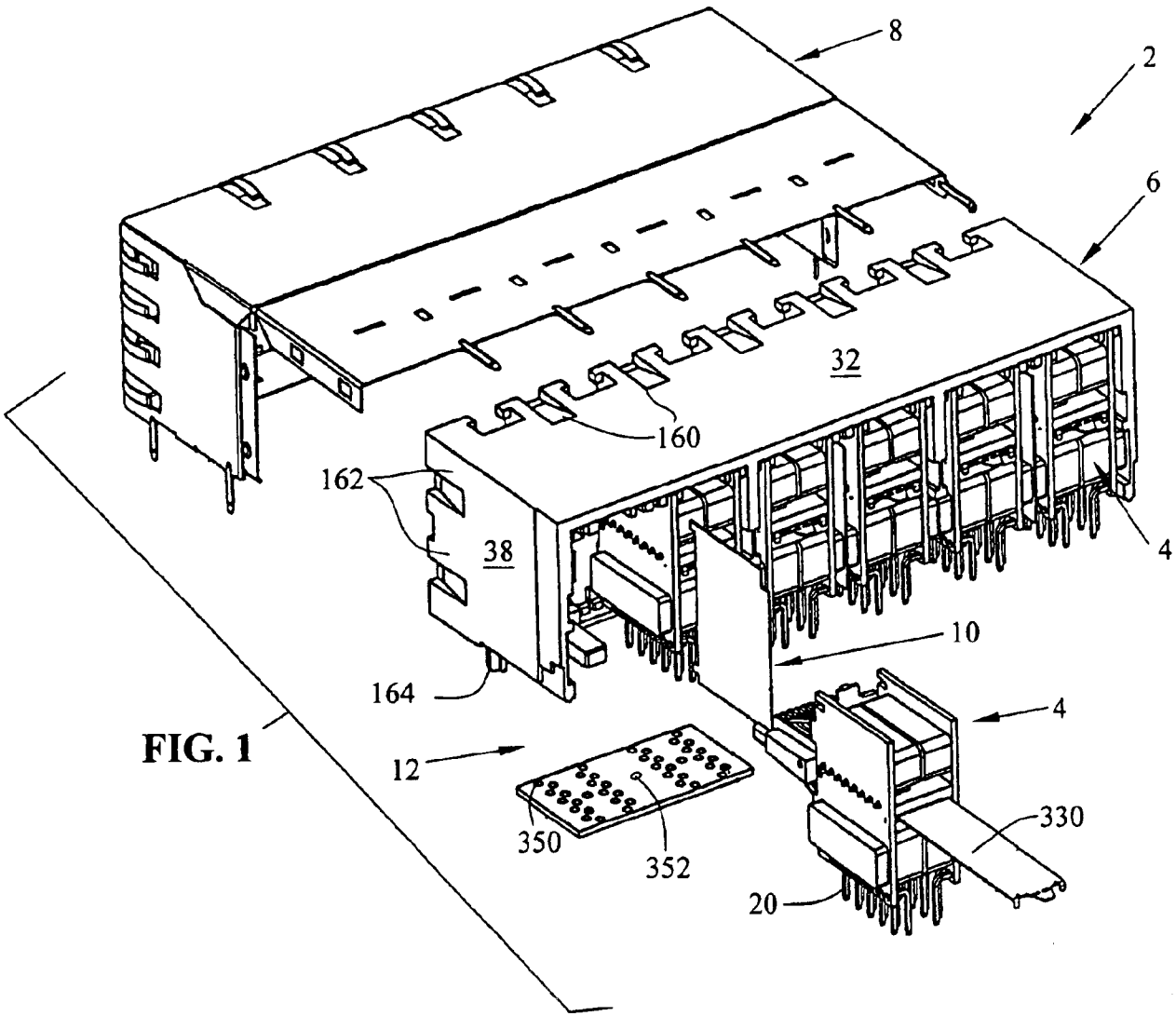
FIG. 1 is a perspective view of the connector assembly partially exploded to show the various components of the invention.

With reference first to FIG. 1, a stacked modular jack assembly is shown generally by reference numeral 2 and includes a plurality of modular jack subassemblies 4, a main housing member 6, and an outer shield member 8. The modular jack subassemblies 4 are positionable within the main housing 6 with an isolation shield 10 positioned between adjacent modular jack subassemblies 4, and with organizer boards 12 positioned below a pair of adjacent modular jack subassemblies 4 as described more fully herein. In the preferred embodiment of the invention, the modular jacks are in the RJ-45 configuration, although it will be recognized that other RJ configurations (e.g., RJ-11) or non-RJ configurations may be utilized consistent with the invention.

Figure 2:
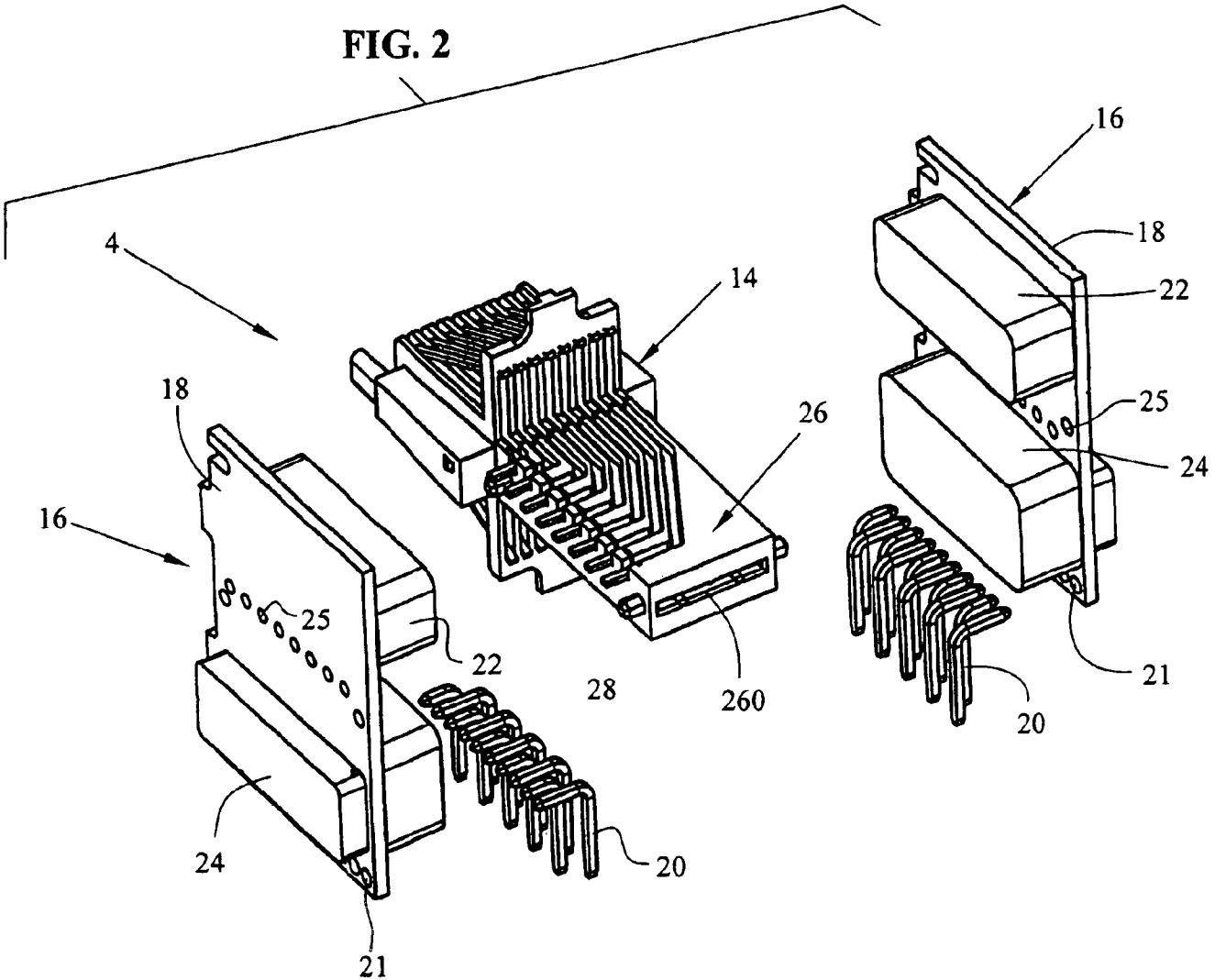
FIG. 2 is an enlarged perspective view of the connector subassembly exploded to show their various components.

With reference now to FIG. 2, the modular jack subassemblies 4 will be described in greater detail. The modular jack subassembly 4 is generally comprised of a modular jack connector member 14 which can be positioned within the housing 6, where the modular jack connector 14 is adapted to receive two signal conditioning assemblies 16 from opposite sides thereof. The filtering assemblies 16 are generally comprised of a printed circuit board 18 having right-angled circuit board contacts 20 extending from, and interconnected to, the circuit board 18, at through holes 21, and passive filtering devices such as components 22 and 24. It should be appreciated that the boards include through holes such as 25, which are electrically connected through circuit traces (not shown), to the contacts 20. The modular jack connector 14 is generally comprised of a housing 26 having a plurality of contacts 28, such that the filtering assemblies 16 may be mounted to the housing 26, with the contacts 28 interconnected to the through holes 25. Furthermore, it will be recognized that while passive filtering is utilized in the illustrated embodiment, the electronic components 22, 24 may comprise literally any type of electronic device including, for example, discrete resistors, capacitors, inductors, or semiconductive devices (e.g., transistors or diodes), or even integrated circuits.

Figure 3:
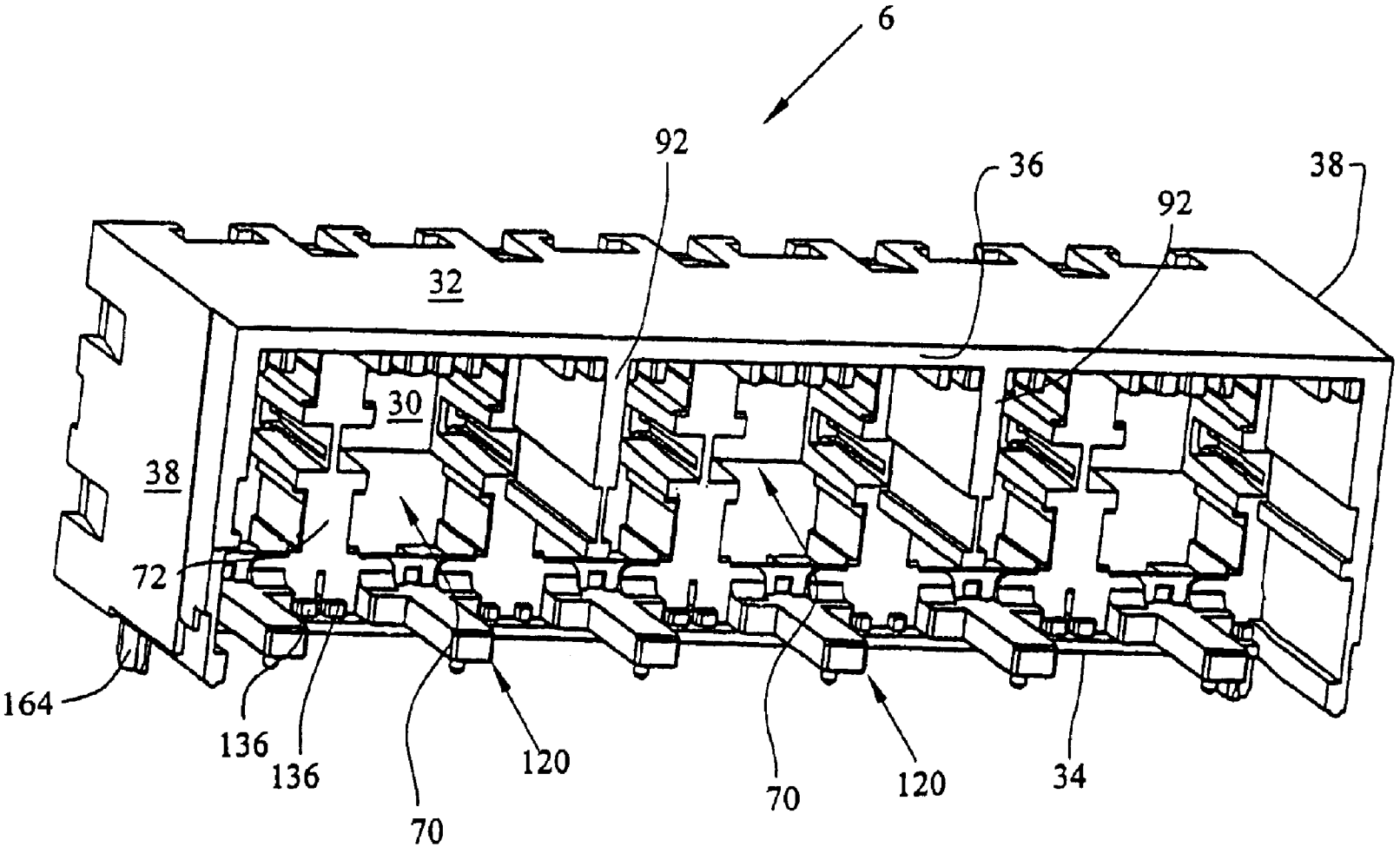
FIG. 3 is a rear perspective view of the main housing portion.
Figure 3A:
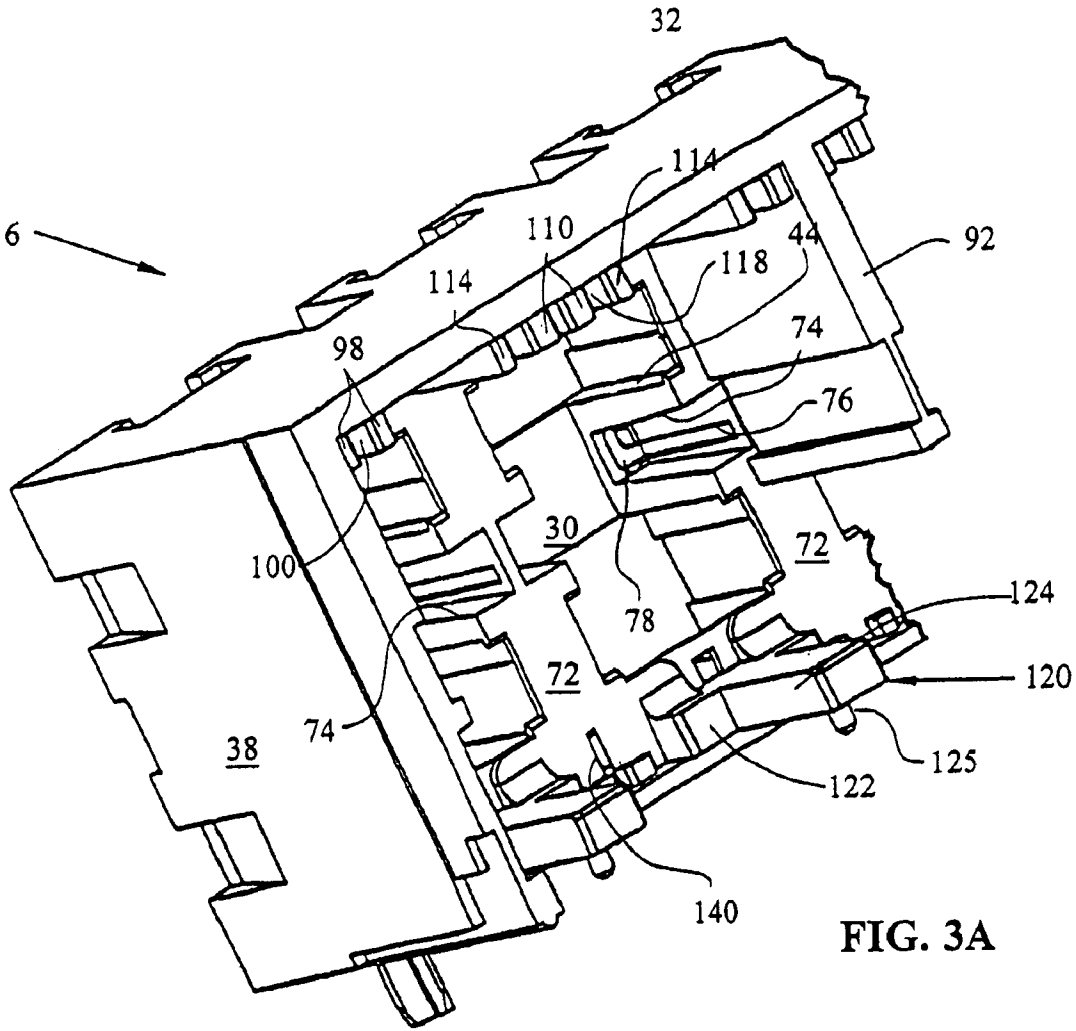
FIG. 3A is an enlarged view, in partial fragmentation, of the main housing portion shown in FIG. 3.
Figure 4:
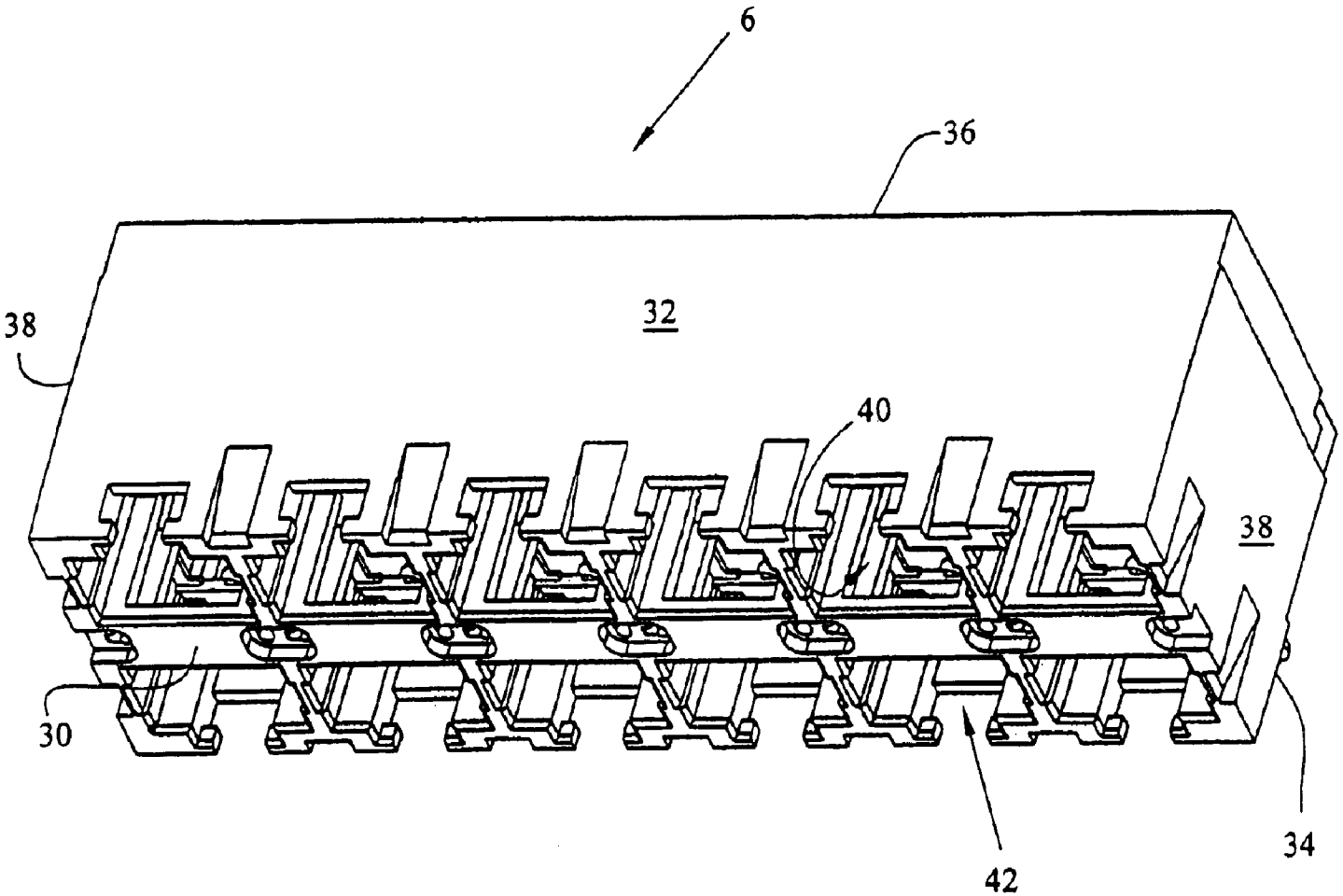
FIG. 4 is a front perspective view of the main housing portion.
Figure 4A:
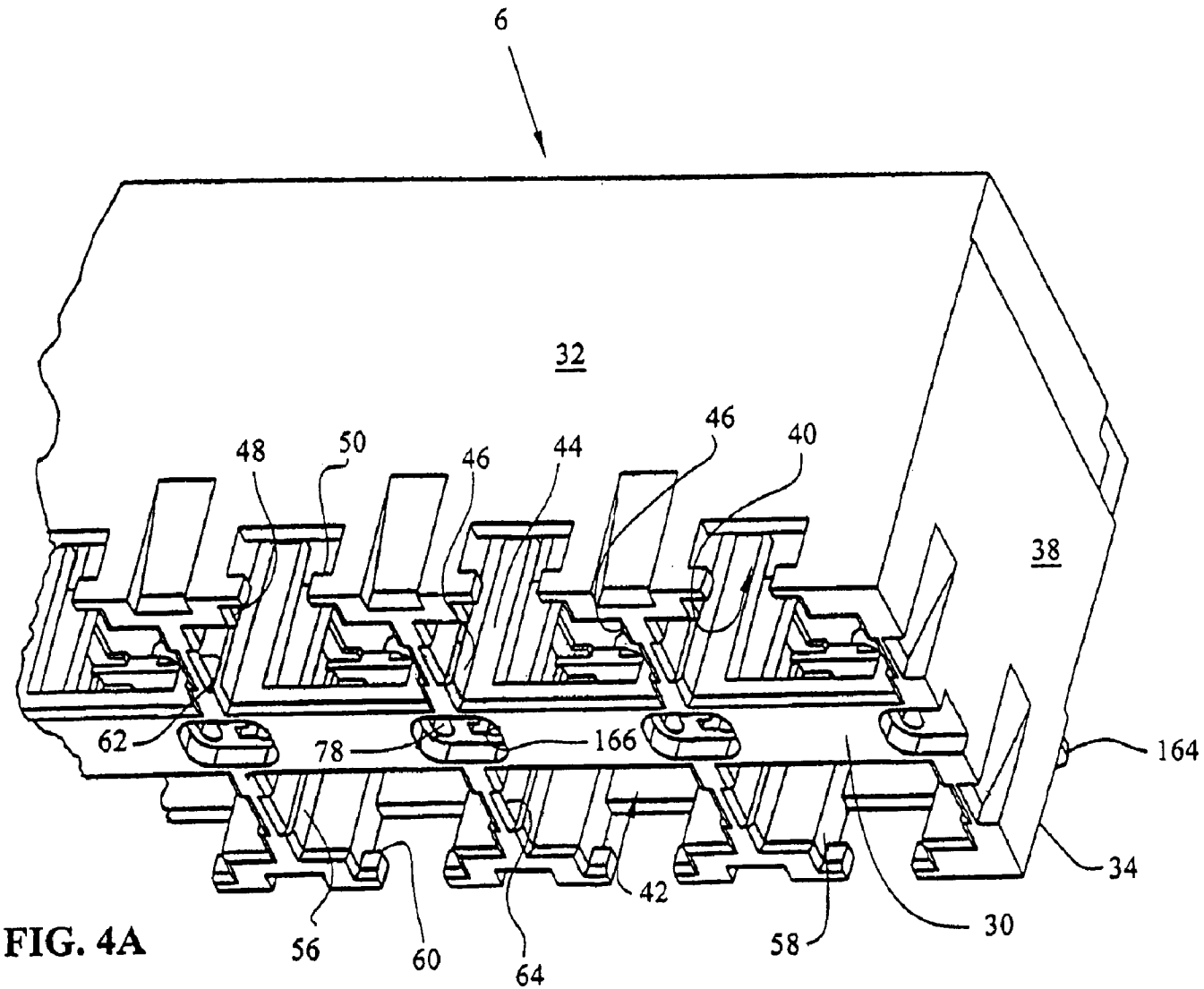
FIG. 4A is a view in partial fragmentation, of the main housing portion shown in FIG. 4.
Figure 5:
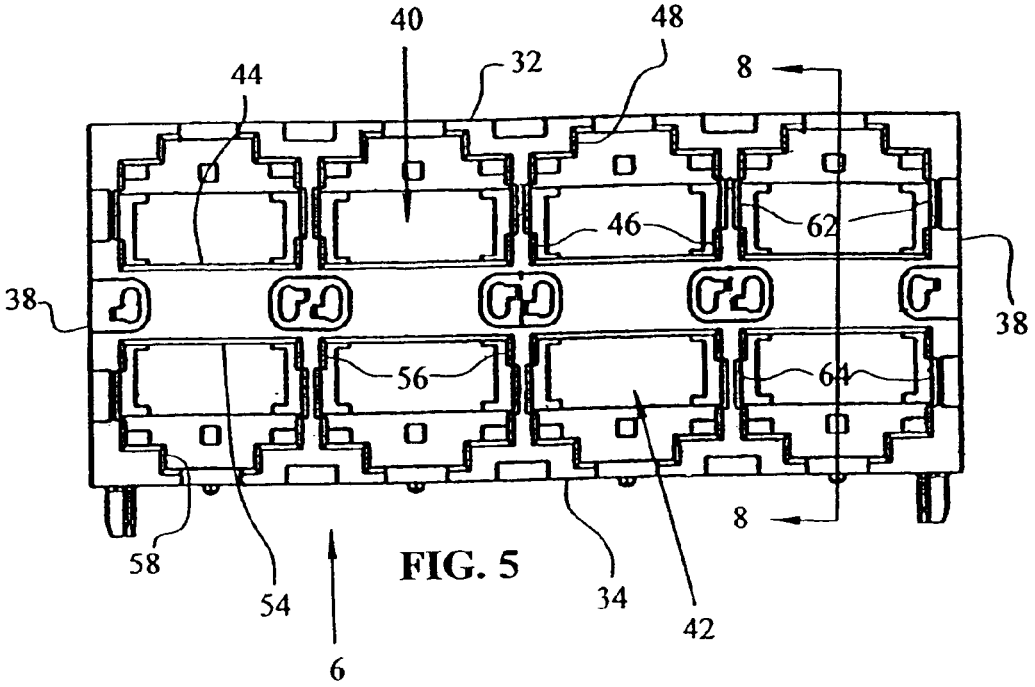
FIG. 5 is a front plan view of the housing shown in FIGS. 3 and 4.

With reference now to FIGS. 3, 3A and 4, 4A, the main housing member 6 will be described in greater detail. As shown in FIG. 4, the housing member 6 generally includes a front mating face 30, a top wall 32, a lower wall 34, a rear face 36, and end walls 38 (only one of which can be viewed in FIGS. 3A and 4A). With reference now to FIGS. 4A and 5, the front face 30 of the housing 6 is shown to include an upper row of modular plug receiving openings 40 and a lower row of modular plug receiving openings 42. The cavities 40 include a lower surface 44, inner parallel side surfaces 46, and a latch-receiving notch 48 together with a rearwardly facing latching surface 50. Similarly, the row of lower cavities 42 includes a top wall 54 (FIG. 5) and inner side walls at 56. A lower latch-receiving recess is provided at 58 with a rearwardly facing latch surface 60. Each of the cavities 40, 42 also includes slots 62 in side walls 46, and slots 64 in side walls 56, to accommodate the modular plug. It should be understood, however, that any such modification to the modular plug receiving openings could be modified to change the configuration of the plug or to accommodate different keying configurations.

Figure 7:
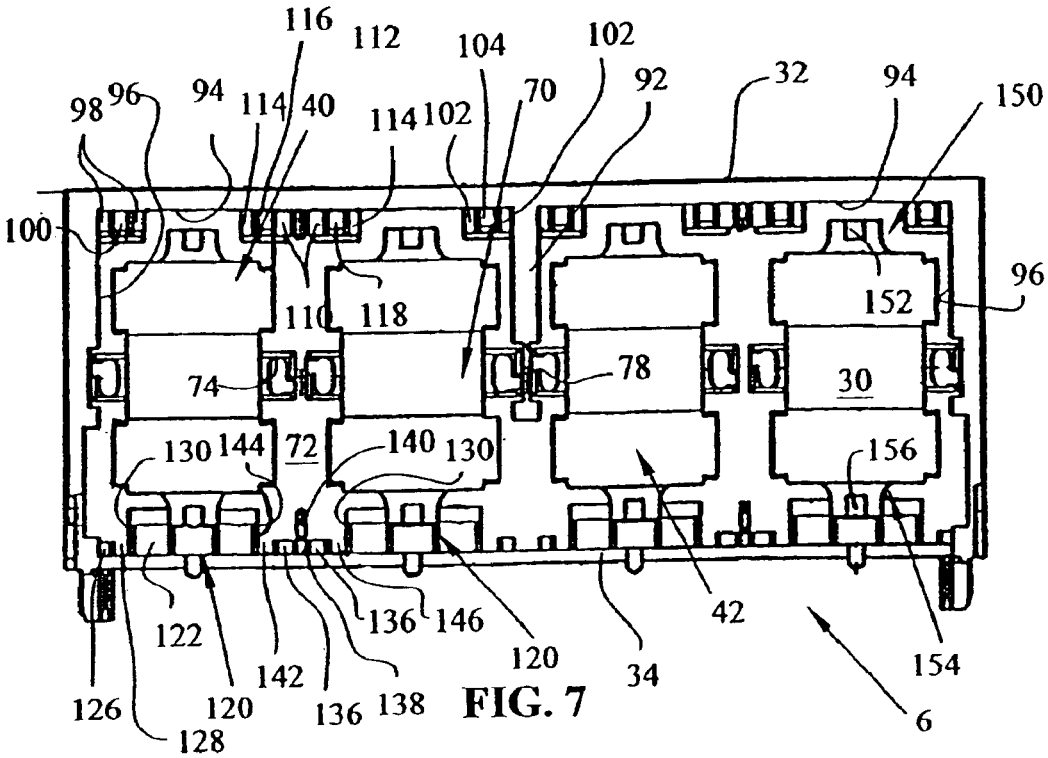
FIG. 7 is a rear perspective view of the housing of FIG. 5.
Figure 8:
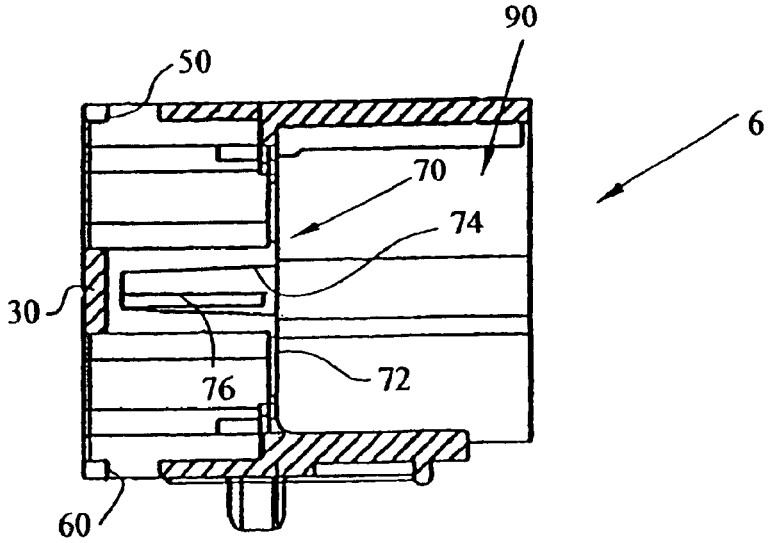
FIG. 8 is a cross-sectional view through lines 8—8 of FIG. 5.

With reference now to FIGS. 3, 3A, 7, and 8, one embodiment of the modular jack receiving area 70 will be described in greater detail. The modular jack receiving area 70 extends forwardly from an intermediate wall shown at 72 to an inner surface of the front wall 30. As shown in FIGS. 3A and 8, a tapered slot is defined at 74, which extends from the intermediate wall 72 towards the front wall 30. The tapered slot also includes a narrow receiving slot 76, described more fully herein. The tapered slot 74 extends forward, and then through the front wall 30 to form an oval-shaped opening at 78 (FIG. 3A).

With respect now to FIGS. 3, 7 and 8, a rear enlarged compartment is shown generally at 90, and extends rearward from the center wall 72. The enlarged areas 90 are separated by intermediate walls 92, which in the preferred embodiment, are positioned to separate side-by-side pairs of openings 40, 42. This enlarged volume exists between inner surface 94 of upper wall 32, inner surfaces 96 of side wall 38, and between intermediate walls 92.

Figure 6:
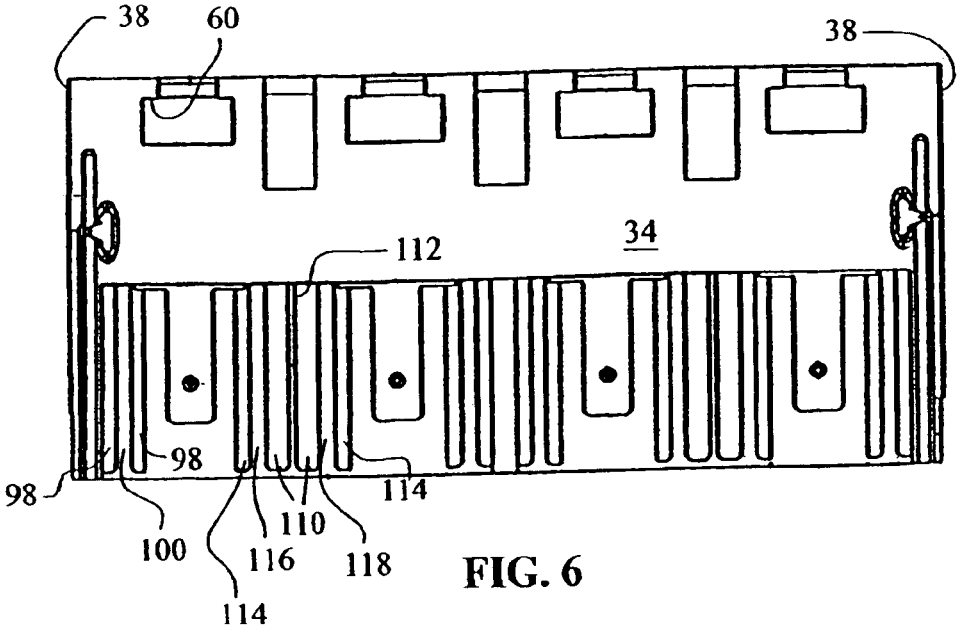
FIG. 6 is a bottom plan view of the housing of FIG. 5.

As shown in FIGS. 3A, 6 and 7, a plurality of aligning devices are provided to align the connector subassembly 4 and intermediate shield 10, with the housing 6. As shown best in FIGS. 6 and 7, a pair of ribs 98 extend rearwardly from the intermediate wall 72 and are positioned in the corner defined by inner surface 96 and upper surface 94, and are spaced apart so as to define a slot at 100. In the adjacent corner that is defined between surface 94 and intermediate wall 92, ribs 102 also define an intermediate slot at 104. Also centrally located between the surfaces 96 and intermediate wall 92 are pairs of ribs, that is, a centrally positioned pair of ribs 110, which defines a central slot 112, and outer ribs 114, which flank the central ribs 110, to define two intermediate slots, that is, 116 and 118. This configuration is repeated in adjacent enlarged areas 90 between each intermediate wall 92, and thus only one such area is described.

With respect now to FIGS. 3A and 7, complementary aligning features are provided extending upwardly from the lower wall 34 to cooperate with the locating features for the connector subassembly 4 and shield 10 as described above. As shown in FIG. 3A, the connector housing 6 includes a T-shaped projection 120, including a transverse portion 122, and a board support portion 124, having a support peg 125. A rib 126 (FIG. 7) is provided such that a slot 128 is defined between rib 126 and side wall 130 of transverse portion 122. With reference still to FIG. 7, two ribs 136 define therebetween slot 138, and a further slot 140 projects into back wall 72. It should be appreciated that slots 138 and 140 are in vertical alignment with slot 112. Furthermore, a slot 142 is defined between side surface 144 of transverse portion 122 and rib 136; and a slot 146 is defined between rib 136 and side surface 130 of the adjacent projection 120. It should be appreciated too that slots 116 and 142; and 118, 146 are in vertical alignment with each other. The housing 6 also includes an upper contoured recess 150 having an aperture at 152 and a lower contoured recess 154 having an aperture at 156, as shown best in FIG. 7.

Finally, as shown in FIG. 1, housing 6 includes a plurality of recesses 160 positioned along the top surface of upper wall 32 and includes recesses 162 extending into side wall 38. Furthermore, housing 6 includes printed circuit board locating lugs 164 extending downwardly therefrom, and as shown in FIG. 4A, includes recesses 166 encircling two adjacent pairs of oval recesses 78.

Figure 9:
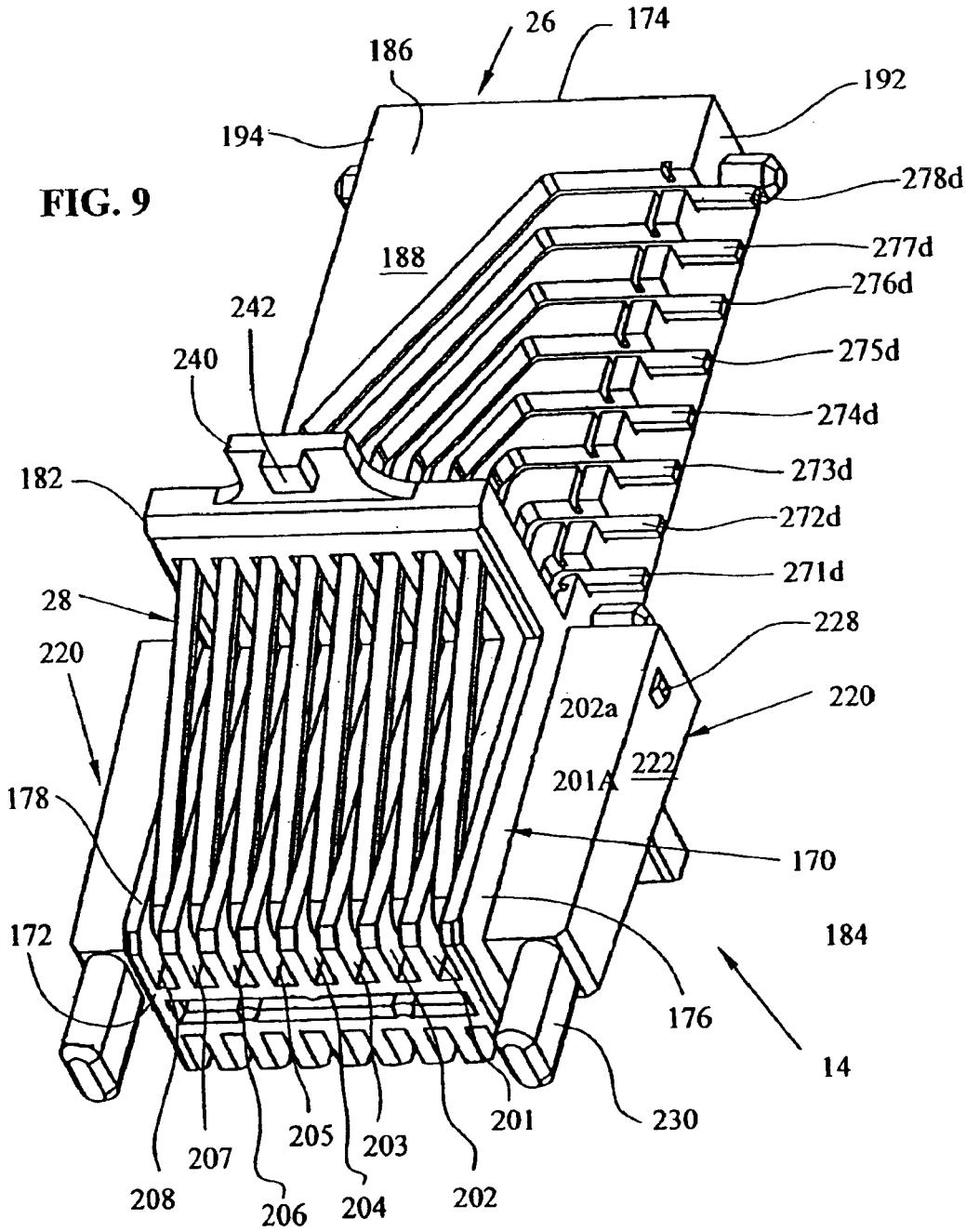
FIG. 9 is a front perspective view of the modular jack subassembly.

With reference now to FIG. 9, the modular jack connector 14 is shown, with housing 26 including an elongate platform housing portion, or beam portion 170, which generally extends between a front mating face 172 and an end face 174. The elongate housing portion 170 includes a front mating section 176 having a top surface at 178 and a lower surface at 180 (FIGS. 12 and 13), where an upper transverse wall 182 extends upwardly from surface 178, and a lower transverse wall 184 extends downwardly from surface 180. The elongate platform portion 170 further includes a rear platform portion 186, which includes an upper face 188, a lower face 190 (FIG. 12), and two transverse faces 192, 194 (FIG. 9) as described in greater detail herein.

Figure 10:
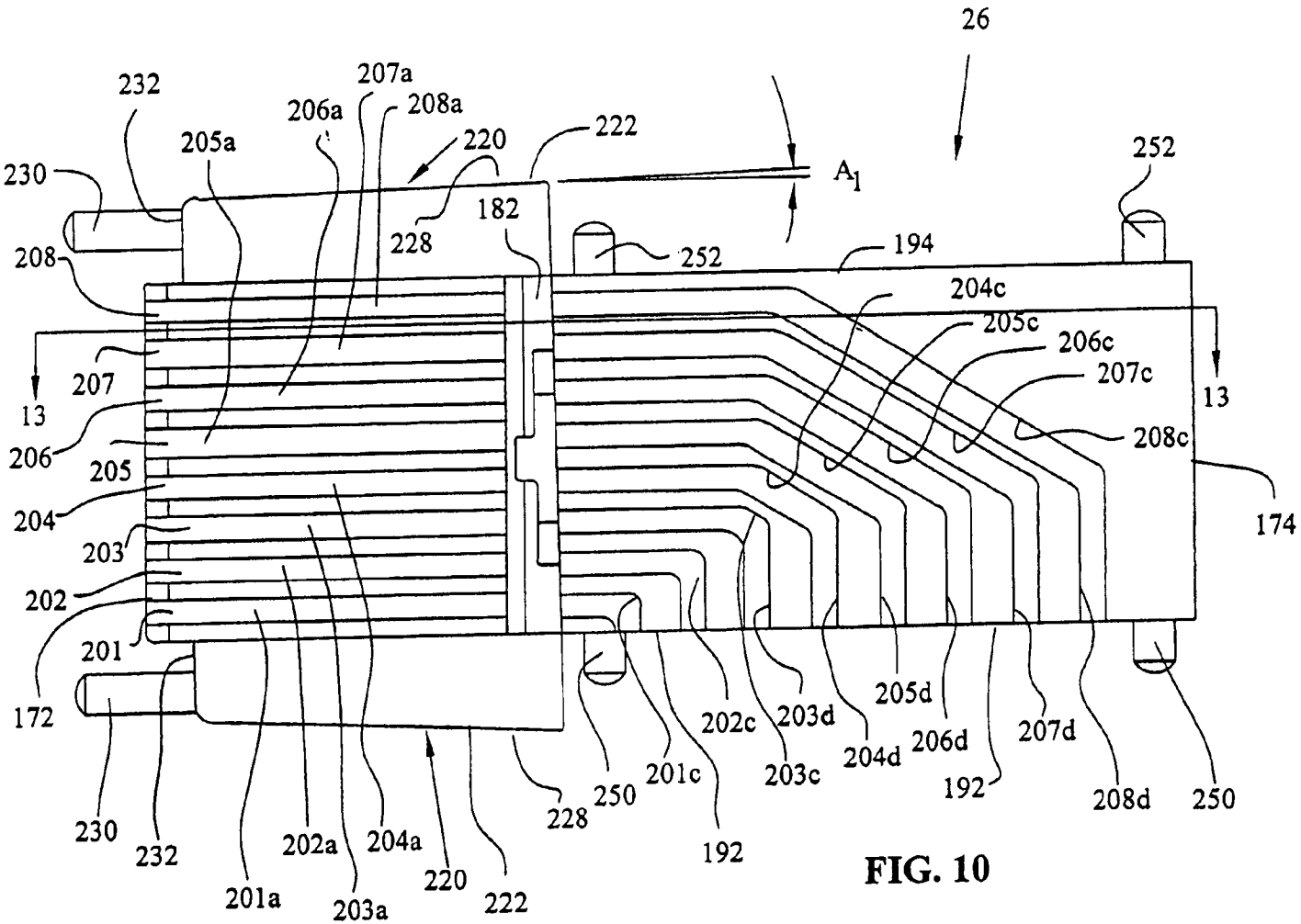
FIG. 10 is a top plan view of the connector housing of FIG. 9 without the contacts loaded.
Figure 11:
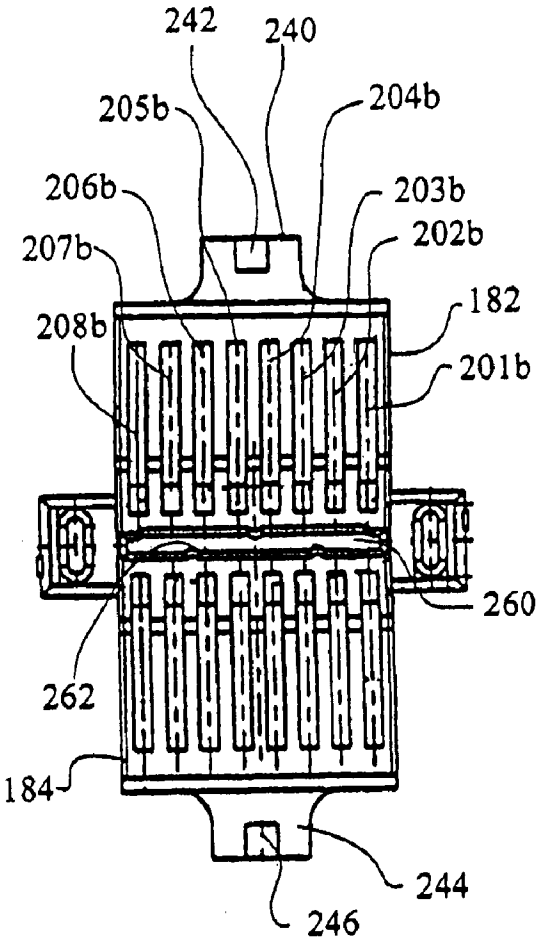
FIG. 11 shows a front plan view of the housing of FIG. 10.

As shown best in FIG. 10, the modular jack housing 26 includes a plurality of slots 201–208, which extend from front face 172 rearwardly towards end face 174. The slots 201–208 include linear portions 201A–208A, extending rearwardly through upstanding wall 182 as shown in FIGS. 10 and 11. As shown best in FIG. 11, the slots 201–208 also include upper vertical portions 201B–208B, which form contact alignment slots as described herein. After extending through the upper transverse wall 182, the linear slot portions 201A–208A include transition sections, for example, 201C–208C, and thereafter right-angled sections 201D–208D, which open onto side face 192, as best shown in FIG. 10. It should be appreciated that lower face 190 includes an identical array of slots such as 201–208, with the exception that the slots are mirror-imaged, such that the slots extend through lower transverse wall 184, and open onto transverse face 194.

Figure 12:
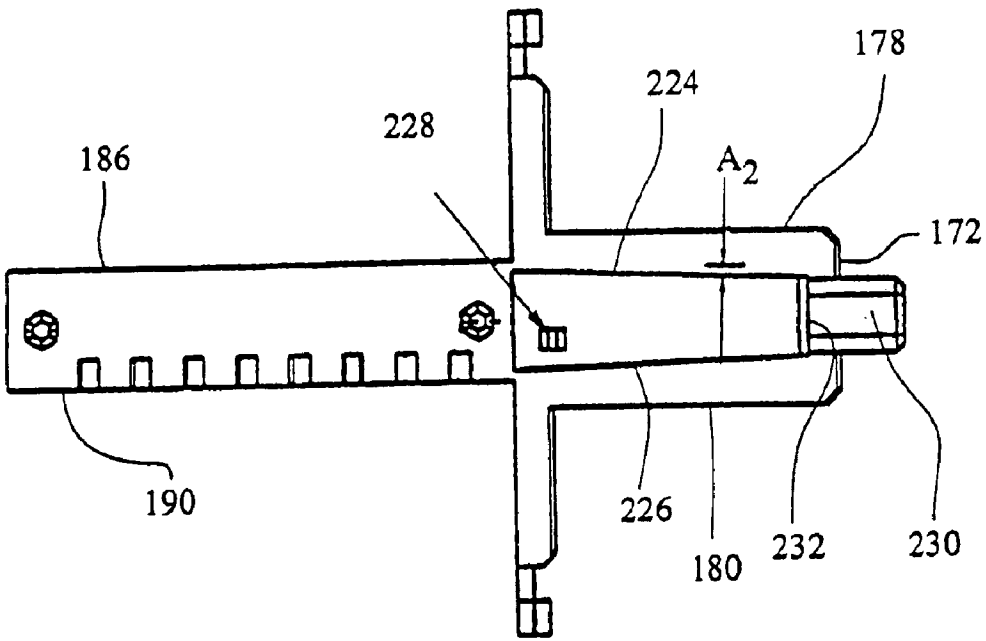
FIG. 12 is a side plan view of the housing of FIGS. 10 and 11.

With respect now to FIGS. 9 through 13, the retention features of modular jack housing 26 will be described in greater detail. As shown first in FIG. 9, the housing 26 includes two side extensions, 220 extending along the front housing portion 176 and includes side surfaces 222 which taper towards front face 172 by angle $A_1$ (FIG. 10) and include top and bottom surfaces 224, 226 which also taper towards front face 172 by angle $A_2$ (FIG. 12). Each side surface 222 further includes a detent mechanism 228 adjacent the end of the side extensions 220. Each of the side extensions 220 further includes at least one locating element (in the illustrated embodiment, an oval-shaped heat stake lug 230 extending from a front end face 232 of the side extensions 220) for, inter alia, locating and positioning the housing 26 when inserted within the outer housing 6. It will be recognized, however, that any number of other types of locating element arrangements may be substituted with equal success, including, for example, heat stakes with other than oval shape, slot-and-groove apparatus, or even the use of lugs extending from the interior surface of the outer housing 6 to mate with corresponding openings formed in the front face 172 of the housing 26, all such alternate embodiments being known to those of ordinary skill.

As shown best in FIGS. 9 and 11, transverse wall 182 includes a contoured wall portion 240 having an extension lug 242, whereas lower transverse wall portion 184 includes a contoured wall section 244 having lug member 246. Furthermore, transverse face 192 includes locating lugs 250, whereas transverse face 194 includes locating lugs 252.

Figures 13, 15:
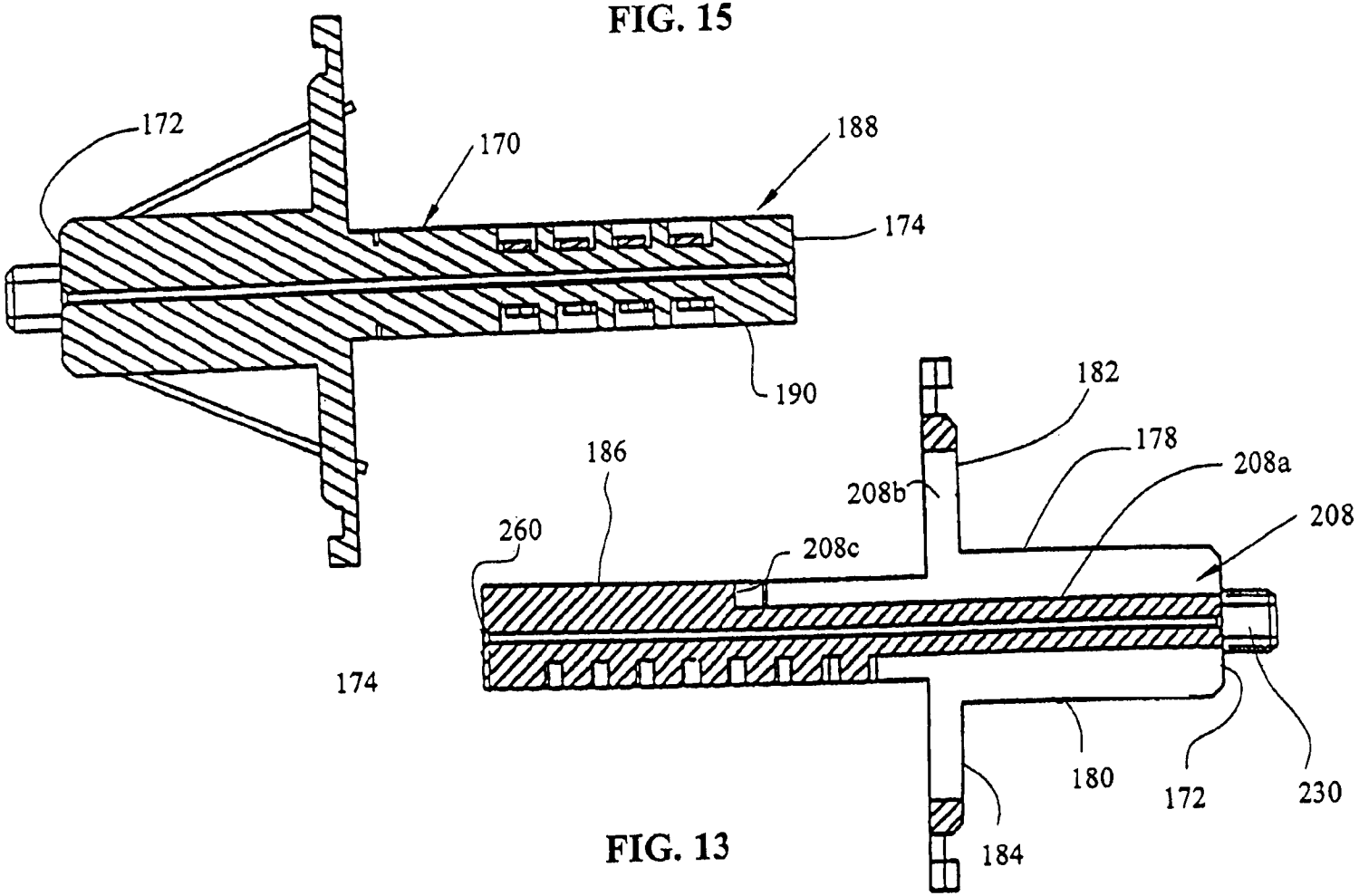
FIG. 13 is a cross-sectional view through lines 13—13 of FIG. 10.
FIG. 15 is a cross-sectional view through lines 15—15 of FIG. 14.

Finally, housing member 26, as best shown in FIGS. 11 and 13, includes an elongate slot member 260 which extends transversely across the terminal receiving slots 201–208 (FIG. 11) and extends between front face 172 and rear face 174 (FIG. 13). As shown best in FIG. 11, the slot 260 includes a plurality of gripping detents 262 positioned on both the top and bottom surfaces of the slot 260.

Figure 14:
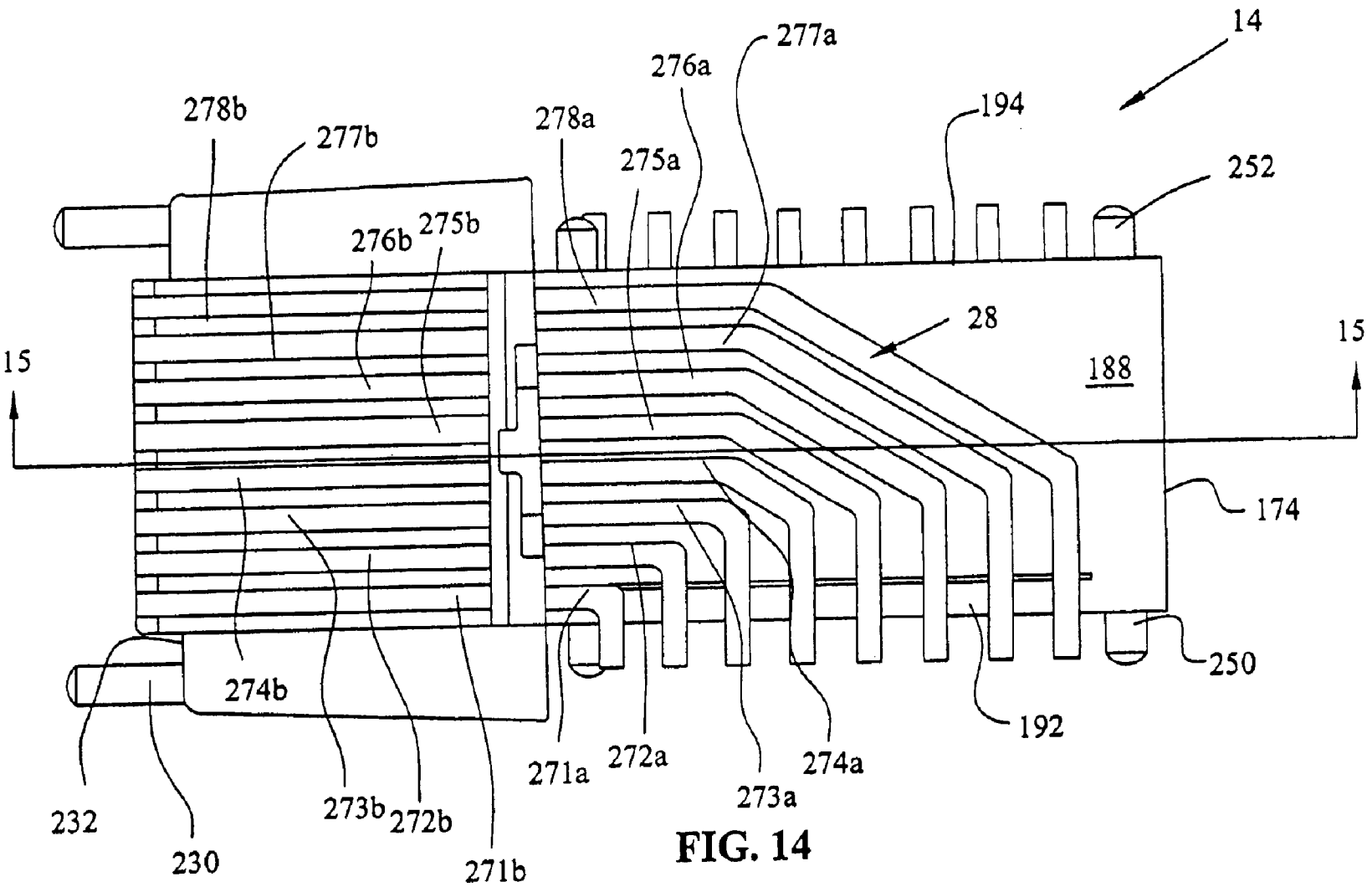
FIG. 14 is a top plan view of the modular jack subassembly shown in FIG. 9.

With reference now to FIGS. 9 and 14, the plurality of electrical terminals 28 will be described in greater detail. With reference first to FIG. 14, the contacts are defined as modular jack contacts, and are stamped and formed from a blank sheet of metal in a lead frame approach such that the terminals are formed, at one end, into right angles for interconnection to a printed circuit board. Thus, the terminals 28 have base portions 271A–278A, which vary in length due to their right-angled nature as is well known in the art. These base portions 271A–278A are positioned within respective channels 201A–208A in the housing (FIG. 10). As shown in FIG. 14, the terminals 28 also include a plurality of reversely bent contact portions, 271B–278B, which reversely bend and extend obliquely rearwardly away from the front face 172 of the modular jack housing 14. These reversely bent portions 271B–278B extend through their associated upstanding slots 201B–208B to provide lateral alignment thereof, and are spring loaded there against. The terminals are thereafter transitioned into printed circuit board contacts 271D–278D as shown in FIG. 9 and extend beyond transverse face 192. While only one side of the connector housing 14 is disclosed, it should be realized that both the connector channels as well as the terminals are identical, but that they are mirror images of each other such that the printed circuit board terminals, such as 271D–278D, extend beyond transverse face 194 as shown in FIGS. 14 and 15.

Figures 16, 17, 18:
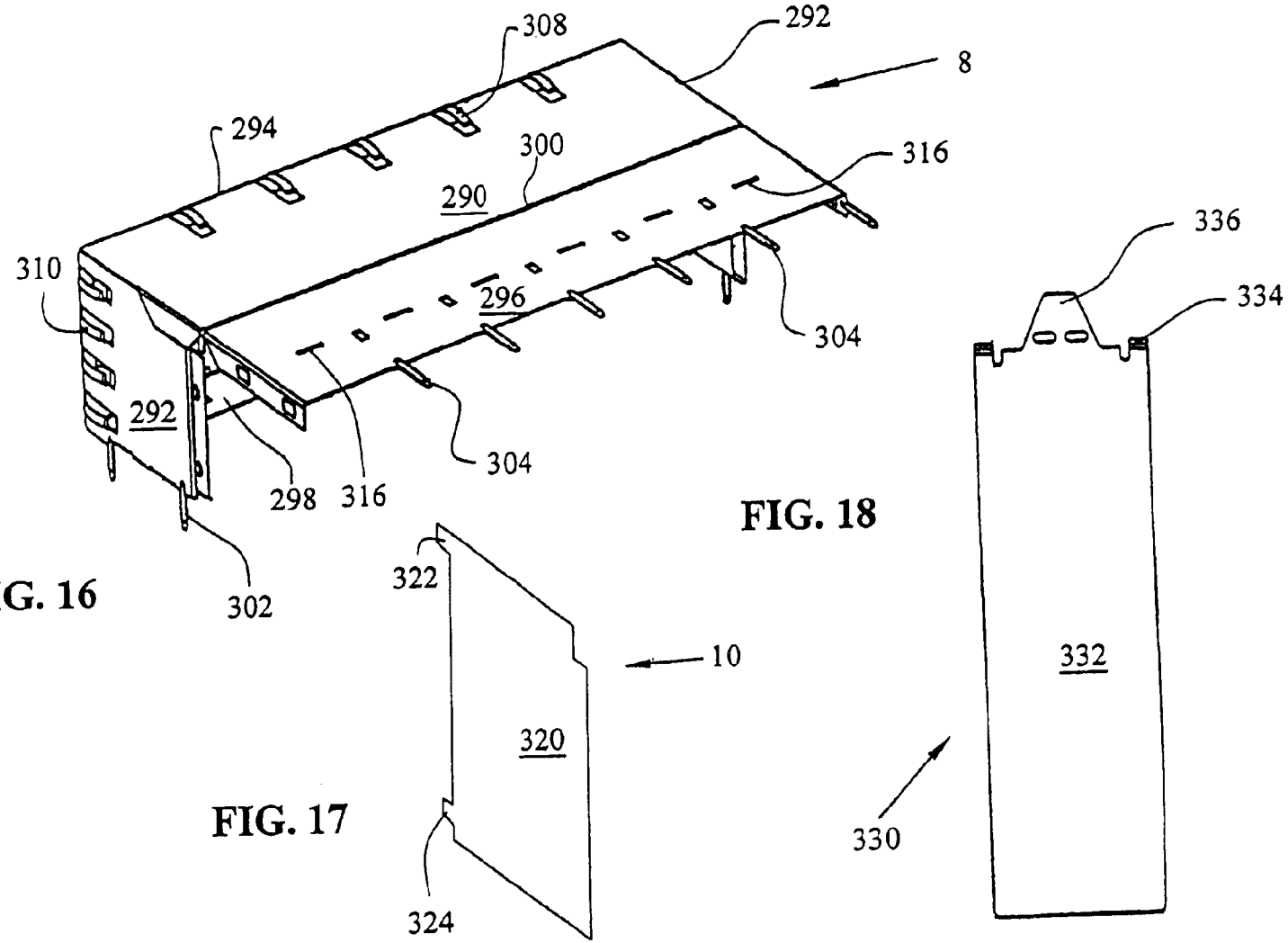
FIG. 16 is a rear perspective view of the outer shield, as shown in FIG. 1.
FIG. 17 is a perspective view of the side shields which are positionable between adjacent connector subassemblies.
FIG. 18 is a plan view of the isolation shield which is positioned through the modular jack beam between the terminal arrays.
Figure 19:
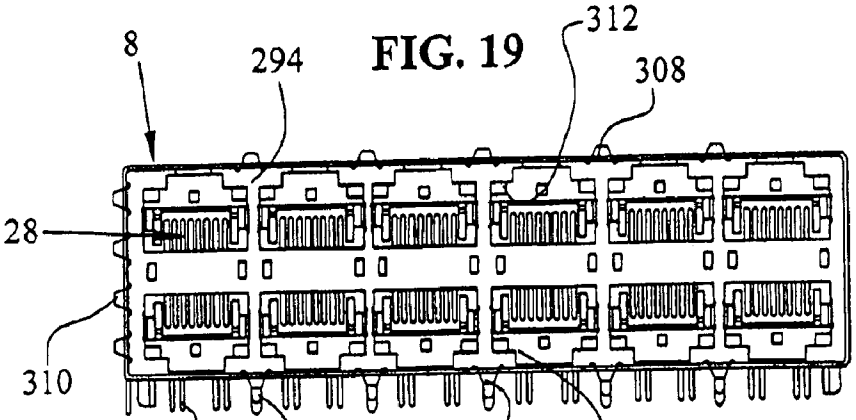
FIG. 19 is a front plan view of the completed assembly.
Figure 20:
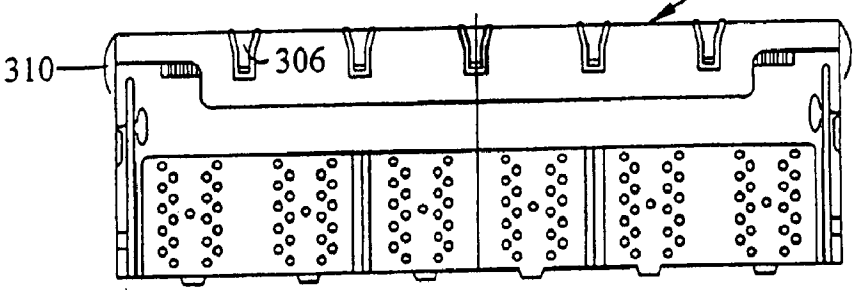
FIG. 20 is a lower plan view of the assembly shown in FIG. 19.
Figure 21:
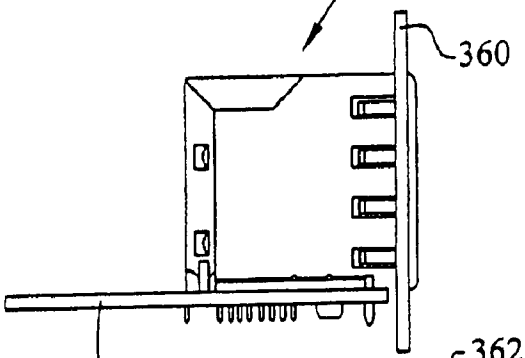
FIG. 21 is a side plan view of the assembly of FIG. 19, with the assembly mounted within a panel opening.
Figure 22:
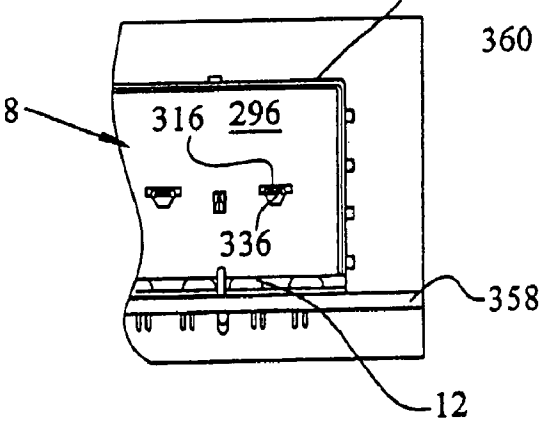
FIG. 22 is a rear plan view of the assembly shown in FIG. 20 in partial fragmentation.

With reference now to FIG. 16, the outer shield member 8 is comprised of a box-shaped stamped and formed metallic enclosure formed by a top wall 290, side walls 292, a front mating face 294, a rear wall 296, and a lower wall 298. It should be understood that this shield in the preferred version of the embodiment is stamped and formed from a single flat piece of sheet metal, however, any type of shield could be employed. As viewed in FIG. 16, the rear wall 296 is shown integrally connected to top wall 290, and is shown in the position ready to receive the housing 6, and is therefore rotatable about the hinged connection at 300. It should be understood that the shield 8 is intended for mounting to a printed circuit board, and therefore side walls 292 include integral printed circuit board tines 302, rear wall 296 includes a plurality of printed circuit board tines 304, and front wall 294 includes printed circuit board tines 306 (FIG. 19). It should also be understood that the shield 8 is intended for receipt within a panel opening and therefore includes a plurality of resilient fingers, such as fingers 308 integrally connected to top wall 290 and fingers 310 integrally connected to side walls 292. Furthermore, the shield 8, as shown in FIG. 19, includes a plurality of stamped openings 312 and 314 which generally conform to the geometry of openings 40 and 42 (FIG. 4A) in the housing 6. Furthermore, rear wall 296 (FIG. 16) includes a plurality of horizontal slots at 316 as will be described in greater detail herein.

With reference now to FIG. 17, shield member 10 is shown as including a generally rectangular metallic member 320 having tabs 322 and 324 extending from a front edge thereof. Also as shown in FIG. 18, a shield member 330 is shown including a rectangular metallic member 332 having ears 334 bent from an edge together with a foldable tab at 336.

With the various components of the assembly as described above, the assembly of the various components will now be described in greater detail. With reference first to FIG. 2, the connector member 14 is first assembled such that the plurality of terminals are positioned in their respective channels with the reversely bent contact portions extending through their respective slots. As shown in FIG. 2, this positions the plurality of printed circuit board terminals 271D–278D (FIG. 9) beyond the transverse faces 192, 194. The various signal conditioning subassemblies 16 are now assembled by positioning the various components 22, 24 on, or through, the board 18 flanking the through holes 25.

It should be appreciated that the through holes 25 are plated through holes such that the printed circuit board terminals 271D–278D can be solder connected to the through holes 25 for electrical connection therewith. It should also be appreciated that through holes 25 are electrically connected to circuit traces (not shown) on the boards 18 which thereafter interconnect with the signal conditioning components 22, 24. These components thereafter are interconnected to plated through holes 21, again by circuit traces on the board 16. Right-angle terminals 20 are thereafter interconnected to through holes 21, preferably by a soldering process to electrically connect the terminals 20 to the printed circuit board 18. It should therefore be appreciated that the plurality of modular jack terminals 28 are electrically connected to the right-angle terminals 20, through the serially connected components 22, 24. The assembled view of the modular jack subassembly 4 is shown in FIG. 2A. As is apparent, due to the low profile nature of the housing 26, particularly above and below surfaces 188, 190, a large volume of space is allotted for the signal conditioning components. The modular jack assembly 4 is completed by positioning the isolation shield 330 within its corresponding slot 260 and sliding the shield to a position adjacent the front face 172.

With the modular jack subassemblies, as described, they are insertable within the connector housing member 6. The subassemblies 4 are positioned within the various cavities so as to align the extension members 220 (FIG. 9) with the tapered slot 74, while at the same time aligning the front edge of edge cards 18 with the various associated slots 100, 116 (FIG. 7). It should also be appreciated that this will position the contoured wall portion 240 within its corresponding opening 150 (FIG. 7) and lug 242 will be positioned within corresponding opening 152. It should also be appreciated that, when the modular jack subassembly 4 is fully inserted within the housing 6, oval-shaped heat stake lugs 230 will extend through their corresponding openings 78 and extend beyond the front face of housing 6. Thus, these lugs can be heat staked with the plastic material melting to form a plastic head within the surrounding opening 166 (FIG. 4A).

The shield members 10 may now be installed intermediate adjacent modular jack assemblies 4, such that the shield 10 is aligned with intermediate slot 112 (FIG. 7) which will also position extension 324 within its corresponding slot 140 (FIG. 3A). Alignment plates 12 may now be slidably received over adjacent subassemblies 4, such that apertures 350 slidably receive over contacts 20, and aperture 352 is slidably received to a position where it is received over lug 125 (FIG. 3A). It should be appreciated that the shield member 8 is now receivable over the above assembly of the modular jack assemblies 4 and housing 6 to the position shown in FIG. 19. In this position, the housing 6 is substantially enclosed by the outer shield member 8. This also provides that the openings 312, 314 correspond with the openings into housing 6, such that modular plugs could be received therein for contact with terminals 28. Finally, the tab 336 of the isolation shield 332 is bent downwardly so as to make grounding contact with rear wall 296 of the shield member 8.

As assembled, the connector 2 is positionable on a printed circuit board 358 with the various terminals 20 aligned and electrically connected with corresponding through holes in the circuit board 358. This entire subassembly is connectable to a panel 360 through an aperture 362 thereof.

The method of manufacturing the connector assembly (including housing 26) of the invention will now be described in detail. It is noted that while the following description of the method is cast in terms of the fabrication of a multiple port pair assembly having two rows of ports in over-under configuration, the broader method of the invention is equally applicable to other configurations, such as those having only a single port pair.

The method generally comprises first forming the outer housing 6 and housing or beam platform 26, such forming being accomplished by any number of well understood formation techniques such as injection or transfer molding. The injection molding process is preferred for its ability to accurately replicate small details of the mold, low cost, and ease of processing.

Next, a plurality of unformed electrically conductive contacts are provided. As previously described, the contacts comprise metallic (e.g., copper or aluminum alloy) strips having a substantially square or rectangular cross-section and sized to fit within the slots of the connectors in the housing 26.

The contacts are partitioned into two sets; a first set comprising contacts 28 for use with the modular jack recess (i.e., within the housing 6, and mating with the modular plug terminals), and a second set as the circuit board contacts 20 for mating with the PCB or other external device to which the connector assembly 2 is mated. The conductors 20, 28 are formed to the desired shape(s) using a forming die or machine of the type well known in the art. Specifically, for the embodiment of FIG. 1, the first set of contacts 28 is deformed so as to produce the juxtaposed, coplanar right angle as previously described. The second set of contacts 20 is deformed to produce the desired juxtaposed, non-coplanar array which is used to mate with the PCB/external device as shown best in FIGS. 2 and 2A herein.

Note also that either or both of the aforementioned sets of contacts may also be notched (not shown) at or near their distal ends such that electrical leads associated with the electronic components (e.g., fine-gauge wire wrapped around a magnetic signal conditioning element) may be wrapped around the notch to provide a secure electrical connection either alone or in conjunction with soldering or other bonding technique.

Next, the circuit boards 18 used within the connector assembly 2 are formed, including any through holes 21 or vias. Methods for forming substrates are well known in the electronic arts, and accordingly are not described further herein. Any conductive traces on the substrate required by the particular design are also added, such that individual ones of the contacts 20, 28, when received within the through holes, are in electrical communication with the traces as required.

Next, the organizer boards 12 are formed and are perforated through its thickness with a number of through holes or apertures 350 of predetermined size. The apertures are arranged in an array, each aperture receiving corresponding ones of the second contacts 20 therein, the apertures of the organizer boards acting to register and add mechanical stability to the second set of contacts 20. Alternatively, the apertures may be formed at the time of formation of the organizer board 12 itself.

One or more electronic components 22, 24, such as the aforementioned signal conditioning devices, are next formed and prepared (if used in the design). The manufacture and preparation of such electronic components is well known in the art, and accordingly is not described further herein. The electronic components are then mated to the circuit boards 18. Note that if no components are used, the conductive traces formed on/within the circuit boards will form the conductive pathway between the first set of contacts 28 and respective ones of the second set of contacts 20. The components 22, 24 may optionally be (i) received within corresponding apertures designed to receive portions of the component (e.g., for mechanical stability), (ii) surface mounted or otherwise bonded to the substrate such as through the use of an adhesive or encapsulant, (iii) mounted in "free space" (i.e., held in place through tension generated on the electrical leads of the component when the latter are terminated to the circuit board conductive traces and/or contact distal ends, or (iv) maintained in position by other means. In the illustrated embodiment, the components 22, 24 are electrically coupled to the PCBs 18 using a eutectic solder re-flow process as is well known in the art. The electronic components 20, 24 is then optionally secured with a silicon encapsulant, although other materials may be used.

The formed modular jack contacts 28 are disposed within respective slots 201–208 in the housing element 26 such that the contacts are properly seated and aligned within the slots as shown best in FIG. 9.

Next, the appropriate ends of the circuit board contacts 20 are inserted into the circuit boards 18, such that the contacts form an array of contacts which project vertically downward from the circuit boards 18 so as to be aligned the corresponding through holes 350 of the organizer board 12 when the latter is mated to the modular jack subassembly 4.

The ends 271–278*d* of the first contacts 28 are sunk within the apertures 25 of the circuit boards 18, respectively, to the desired depth and optionally bonded thereto (such as by using eutectic solder bonded to the contact and surrounding circuit board terminal pad or trace) in addition to being frictionally received within their respective apertures 25, the latter being slightly undersized so as to create the aforementioned frictional relationship. As yet another alternative, the distal ends of the contacts 28 may be tapered such that a progressive frictional fit occurs, the taper adjusted to allow the conductor penetration within the circuit board 18 to the extent (e.g., depth) desired.

The organizer board 12 is next added to the modular jack subassembly 4 as previously described, such that the distal ends of the circuit board contacts 20 project vertically downward from the subassembly through the through holes 350 of the organizer board 12.

The noise shield member 330 is next inserted horizontally within the slot formed between the upper and lower modular jack contact sets 28 in the assembled modular jack subassembly 4.

The finished modular jack subassemblies 4 are then inserted into the housing 6, such that each subassembly 4 is received into its respective receiving area 70, and the locating lugs 230 on the front face 172 of the housing element 26 received within the corresponding openings 78 formed in the main connector housing 6. Additionally, any isolation shields 10 used in the connector are inserted between the subassemblies 4 as shown most clearly in FIG. 1.

Lastly, the locating lugs 230 are heat staked (i.e., melted) within the recess 166 surrounding the openings 70 such that the subassemblies 4 are fixedly retained within the housing 6.

It will be recognized that while certain aspects of the invention are described in terms of a specific sequence of steps of a method, these descriptions are only illustrative of the broader methods of the invention, and may be modified as required by the particular application. Some steps may be rendered unnecessary or optional under certain circumstances. Additionally, certain steps or functionality may be added to the disclosed embodiments, or the order of performance of two or more steps permuted. All such variations are considered to be encompassed within the invention disclosed and claimed herein.

What is claimed is:

1. An electrical connector assembly, comprising:

a modular jack subassembly including:

an elongate beam platform having a front end, a rear end, upper and lower surfaces, and side edges;

a plurality of electrical contacts positioned on said elongate beam platform, including an upper row of contacts adjacent to said upper surface and a lower row of contacts adjacent to said lower surface, each of said upper and lower rows of contacts having mating contact portions extending adjacent to said front end, and said upper row of contacts having printed circuit board connecting contacts extending beyond one of said side edges, and said lower row of contacts having printed circuit board connecting contacts extending beyond an opposite one of said side edges; and signal conditioning devices comprised of printed circuit cards having signal conditioning components thereon, mounted to said side edges and electrically connected to said printed circuit card connecting contacts.

2. The assembly of claim 1, further comprising an outer housing having a front face having a pair of plug receiving openings including an upper plug receiving opening and a lower plug receiving opening, and said modular jack subassembly is positioned in said outer housing with said upper row of contacts adjacent to said upper plug receiving opening and with said lower row of contacts adjacent to said lower plug receiving opening.

3. The assembly of claim 2, wherein said elongate beam platform includes a plurality of channels within said upper and lower surfaces to receive said contacts.

4. The assembly of claim 3, wherein said electrical contacts are formed as modular jack contacts with base portions extending in said channels, and reversely bent portions extending away from said upper and lower surfaces.

5. The assembly of claim 4, wherein said outer housing includes upper and lower front compartments for receipt of said reversely bent portions, and upper and lower rear compartments, above and below said elongate beam platform.

6. The assembly of claim 5, wherein said signal conditioning components are located within the upper and lower rear compartments.

7. The assembly of claim 6, further comprising printed circuit board pins connected to said printed circuit cards, wherein said printed circuit board pins are interconnected to said printed circuit card connecting contacts through said printed circuit cards and through said signal conditioning components.

8. The assembly of claim 7, wherein said signal conditioning components are positioned on inside facing surfaces of said printed circuit cards.

9. The assembly of claim 8, wherein said printed circuit board pins are positioned within said inside facing surfaces of said printed circuit cards.

10. The assembly of claim 2, further comprising a plurality of pairs of said plug receiving openings, defining a row of upper plug receiving openings, and a row of lower plug receiving openings; and further comprising a plurality of modular jack subassemblies aligned with said upper and lower plug receiving openings.

11. The assembly of claim 10, wherein a shield member is positioned between at least some of said modular jack subassemblies.

12. An electrical connector assembly, comprising:

a housing member having an upper row of plug receiving openings and a lower row of plug receiving openings, said upper and lower rows of plug receiving openings being laterally aligned;

an elongate beam platform having a front end, a rear end, upper and lower surfaces, and side edges; and a plurality of electrical contacts positioned on said elongate beam platform, including an upper row of contacts adjacent to said upper surface and a lower row of contacts adjacent to said lower surface, each of said upper and lower rows of contacts having mating contact portions extending adjacent to said front end, and said upper row of contacts having printed circuit board connecting contacts extending beyond one of said side edges, and said lower row of contacts having printed circuit board connecting contacts extending beyond an opposite one of said side edges;

said elongate beam platform and said contacts being receivable within said housing member to align said mating contact portions with associated said plug receiving openings.

13. The assembly of claim 12, further comprising printed circuit cards mounted to said side edges of said elongate beam platform.

14. The assembly of claim 13, further comprising printed circuit board pins extending downwardly from said printed circuit cards for connection to a printed circuit board.

15. The assembly of claim 14, wherein said electrical contacts are electrically interconnected to said printed circuit board pins through said printed circuit cards.

16. The assembly of claim 15, wherein signal conditioning devices are positioned on said printed circuit cards, intermediate said printed circuit board connecting contacts and said printed circuit board pins.

17. The assembly of claim 16, wherein said signal conditioning devices are positioned on inside facing surfaces of said printed circuit cards.

18. The assembly of claim 17, wherein said printed circuit board pins are positioned within said inside facing surfaces of said printed circuit cards.

19. The assembly of claim 18, wherein said assembly further comprises an outer shield member substantially surrounding said housing member.

20. The assembly of claim 19, further comprising a shield member positioned between said upper row of contacts and said lower row of contacts.

21. An electrical connector assembly, comprising:

a housing member having an upper plug receiving opening and a lower plug receiving opening, said upper and lower plug receiving openings being laterally aligned;

a modular jack connector comprising an elongate platform having a front end, a rear end, and upper and lower surfaces, said modular jack connector further comprising a plurality of upper and lower electrical conductors, said upper electrical conductors comprising mating contacts extending upwardly from said upper surface of said platform, and upper intermediate conductors adjacent said upper surface and extending towards said rear end, said lower electrical conductors comprising mating contacts extending downwardly from said lower surface, and lower intermediate conductors adjacent said lower surface and extending towards said rear end, and substrates mounted to said elongate platform, said substrates having printed circuit board connecting contacts extending therefrom for further connection to a printed circuit board, said substrates being mounted orthogonally relative to said elongate platform, and carrying signal conditioning devices thereon, said printed circuit board connecting contacts being commoned to select ones of said upper and lower electrical conductors, through said substrates and through said signal conditioning devices.

22. The assembly of claim 21, wherein said elongate platform includes a plurality of channels within said upper and lower surfaces to receive said upper and lower electrical conductors.

23. The assembly of claim 22, wherein said upper and lower electrical conductors are formed as modular jack contacts with base portions extending in said channels, and reversely bent portions extending away from said upper and lower surfaces.

24. The assembly of claim 23, wherein said upper electrical conductors have printed circuit board connecting contacts extending beyond one side edge of said elongate platform, and said lower electrical conductors have printed circuit board connecting contacts extending beyond an opposite side edge of said elongate platform.

25. The assembly of claim 24, wherein said substrates are comprised of printed circuit cards mounted to said side edges and electrically connected to said printed circuit card connecting contacts.

26. The assembly of claim 25, wherein said signal conditioning components are positioned on inside facing surfaces of said printed circuit cards.

27. The assembly of claim 26, wherein said printed circuit board connecting contacts are positioned within said inside facing surfaces of said printed circuit cards.

28. The assembly of claim 21, further comprising a plurality of pairs of plug receiving openings, defining a row of upper plug receiving openings, and a row of lower plug receiving openings; and further comprising a plurality of modular jack connectors aligned with said upper and lower plug receiving openings.

29. The assembly of claim 28, wherein a shield member is positioned between at least some of said modular jack connectors.

30. The assembly of claim 29, wherein said assembly further comprises an outer shield member substantially surrounding said housing member.

31. Electrical connector apparatus, comprising:

an elongate beam platform having a front end, a rear end, upper and lower surfaces, and side edges;

a plurality of electrical contacts positioned at least partly on said elongate beam platform, including an upper row of contacts adjacent to said upper surface and a lower row of contacts adjacent to said lower surface, each of said upper and lower rows of contacts having mating contact portions extending adjacent to said front end, and said upper row of contacts having printed circuit board connecting contacts extending beyond one of said side edges, and said lower row of contacts having printed circuit board connecting contacts extending beyond an opposite one of said side edges.

32. The apparatus of claim 31, further comprising a plurality of slots formed within said elongate beam platform and communicating with said front end, said slots receiving at least a portion of corresponding ones of said contacts therein.

33. The apparatus of claim 31, further comprising a wall element extending substantially above said upper and lower surfaces.

34. The apparatus of claim 31, wherein said elongate beam platform further comprises at least one slot formed at least partly between said upper and lower rows of electrical contacts, said at least one slot receiving a noise shield element at least partly therein.

35. The apparatus of claim 31, further comprising at least one locating element disposed substantially on said front end of said elongate beam platform.

36. The apparatus of claim 35, wherein said at least one locating element comprises at least one oval heat stake extending from said front end.

37. The apparatus of claim 35, further comprising a wall element extending above said upper and lower surfaces.

38. The apparatus of claim 35, further comprising locating lugs disposed adjacent to at least one of said side edges of said beam platform, said locating lugs being adapted to cooperate with respective openings in at least one circuit board to maintain said circuit board and said beam platform in substantial alignment when mated together.

39. The apparatus of claim 31, further comprising at least one circuit board having a plurality of conductive pathways associated therewith, said circuit board adapted to cooperate with said elongate beam platform such that said circuit board connecting contacts maintain electrical contact with respective said conductive pathways when said at least one circuit board and said elongate beam platform are mated.

40. The apparatus of claim 39, wherein said at least one circuit board is substantially perpendicular to the elongate dimension of said elongate beam platform when said circuit board and platform are mated.

41. The apparatus of claim 39, further comprising a plurality of electronic components in conductive contact with at least a portion of said conductive pathways.

42. The apparatus of claim 41, wherein said electronic components comprise passive magnetic filtering devices.

43. An electrical connector assembly, comprising:

a housing member having an upper plug receiving opening and a lower plug receiving opening, said upper and lower plug receiving openings being laterally aligned;

a modular jack connector comprising an elongate platform having a front end, a rear end, upper and lower surfaces, and side surfaces, said modular jack connector further comprising a plurality of upper and lower electrical conductors, said upper electrical conductors comprising mating contacts extending upwardly from said upper surface of said platform, and conductor connecting sections extending from one of said side surfaces of said platform, and said lower electrical conductors comprising mating contacts extending downwardly from said lower surface, and conductor connecting sections extending from an opposite one of said side surfaces;

substrates substantially orthogonal to said elongate platform and having connecting contacts extending therefrom for further connection to an external device, said substrates carrying electrical components thereon, said connecting contacts being commoned to select ones of said upper and lower electrical conductors, through said substrates and through said electrical components;

at least one noise shield element disposed at least partly between said upper and lower electrical conductors; and noise shielding disposed around at least a portion of the outer surface of said housing member.

44. The connector assembly of claim 43, further comprising at least one organizer board having a plurality of apertures adapted to receive respective ones of said connecting contacts.

45. An electrical connector assembly, comprising:

a modular jack housing comprising means for supporting having a front end, a rear end, upper and lower surfaces, and side edges;

a plurality of contact means positioned on said modular jack housing, including a plurality of upper contact means adjacent to said upper surface and a plurality of lower contact means adjacent to said lower surface, each of said pluralities of upper and lower contact means having mating contact means for mating with corresponding mating contact means of a modular plug, and printed circuit board connecting means extending beyond respective said side edges; and means for signal conditioning comprised of circuit boards having signal conditioning components thereon, mounted to said side edges of said means for supporting and in electrical communication with said circuit board connecting means.

* * * * *